United States Patent [19]

Daniels et al.

[11] Patent Number: 4,736,534

[45] Date of Patent: Apr. 12, 1988

[54] DITCHER METHOD AND APPARATUS

[75] Inventors: Gordon E. Daniels, Concord; Robert C. Crosby, Knoxville, both of Tenn.

[73] Assignee: The Marmon Group, Inc., Knoxville, Tenn.

[21] Appl. No.: 342,127

[22] Filed: Jan. 25, 1982

[51] Int. Cl.[4] ..... E02F 5/08

[52] U.S. Cl. ..... 37/91; 37/104; 37/DIG. 20; 37/195

[58] Field of Search ..... 37/84, 91, 95, 108 R, 37/102, 189, 190, 104, DIG. 20; 114/260, 322, 323, 39, 61, 123

[56] References Cited

U.S. PATENT DOCUMENTS

| | | | |
|---|---|---|---|
| 1,216,779 | 2/1917 | Dankel et al. | 37/91 X |
| 1,864,552 | 6/1932 | Protzeller | 37/84 |
| 3,683,522 | 8/1972 | Rousseau et al. | 37/91 |
| 3,841,254 | 10/1974 | Dragonas et al. | 114/260 X |
| 3,967,396 | 7/1976 | Maisonneuve et al. | 37/190 X |
| 4,009,531 | 3/1977 | Metrier | 37/190 X |
| 4,106,226 | 8/1978 | Hanson | 37/190 |
| 4,120,106 | 10/1978 | Smith et al. | 37/190 |

FOREIGN PATENT DOCUMENTS

| | | | |
|---|---|---|---|
| 767302 | 1/1957 | United Kingdom | 37/84 |
| 2081345 | 2/1982 | United Kingdom | 37/91 |

OTHER PUBLICATIONS

"Rotary Ditcher", *Progressive Railroading*, p. 83, Mar. 1981.

*Primary Examiner*—Edgar S. Burr
*Assistant Examiner*—Moshe I. Cohen
*Attorney, Agent, or Firm*—Wood, Dalton, Phillips, Mason & Rowe

[57] ABSTRACT

A ditching method and apparatus wherein an excavator wheel provided with an annular array of peripheral scoops is rotated about a horizontal axis while the wheel is moved along the terrain alongside a railroad track. The axis of rotation of the wheel is positioned selectively to be disposed within the range of perpendicular to the longitudinal extent of the track to substantially parallel thereto, whereby the scoops excavate a ditch correspondingly in the range of a narrow trench having a width equal to the transverse extent of the scoops to a wide ditch having a profile corresponding generally to the circumference of the wheel. The wheel is carried on the distal end of a boom having the opposite end mounted to a wheeled support. The wheels are carried on suitable trucks adjustably connected to the support to permit leveling of the support. In one form, the wheel is reversibly rotated and provided with double-ended scoops to permit excavation in either direction of rotation of the wheel. In one form, the wheel is swingable about a vertical axis on the distal end of the boom so as to be positionable on either side of the boom in use. The wheeled support, in one form, is provided with a laterally opening recess for accommodating the wheel in a storage position. The excavated material, in the illustrated embodiment, is conveyed from the excavator wheel by conveyor belts for desired disposal selectively at either side of the railroad track or to a suitable hopper car. The excavator wheel is arranged to drop the excavated material downwardly from the scoops at an upper position onto a subjacent conveyor belt for disposal.

11 Claims, 3 Drawing Sheets

FIG. 3
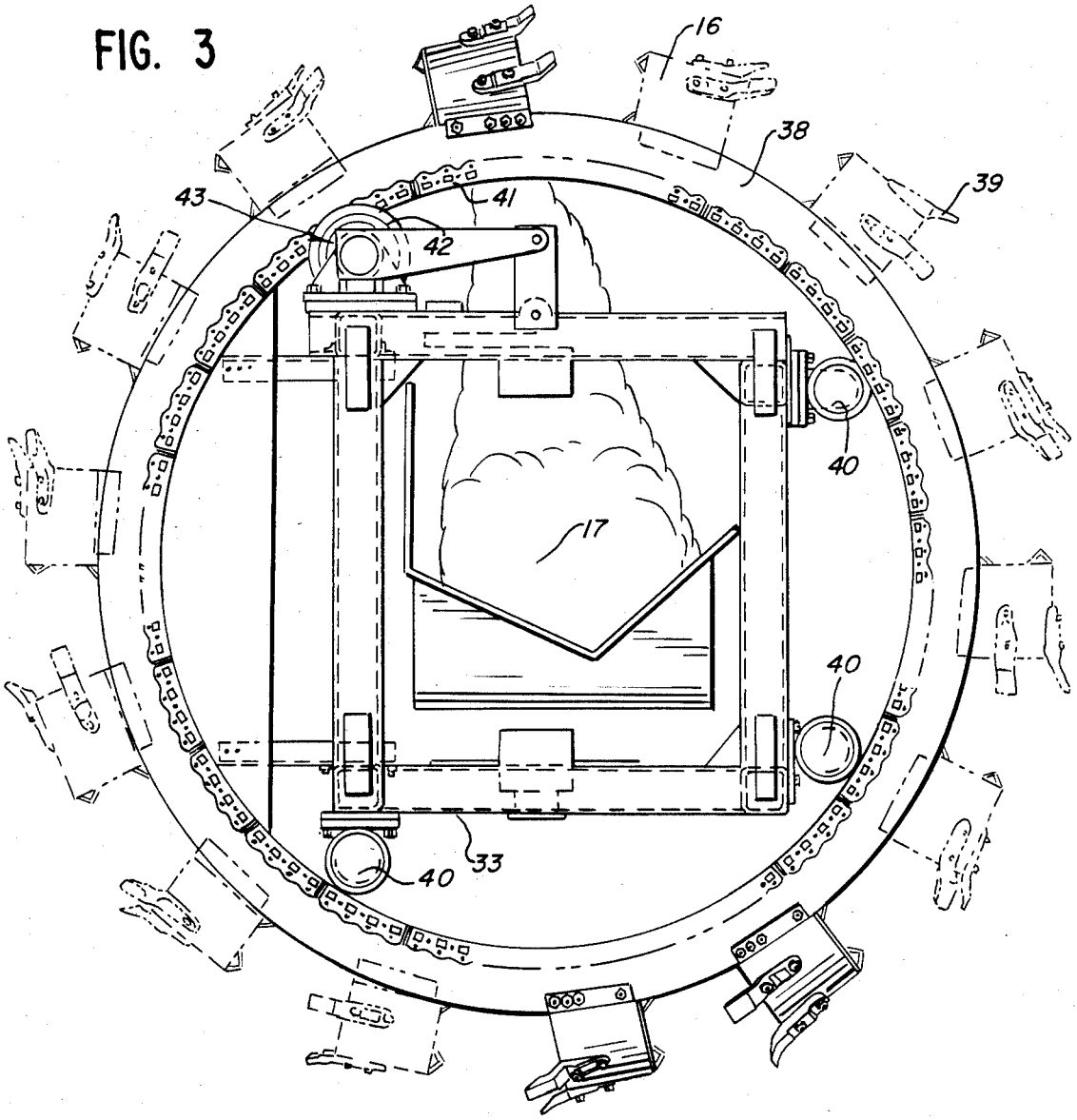
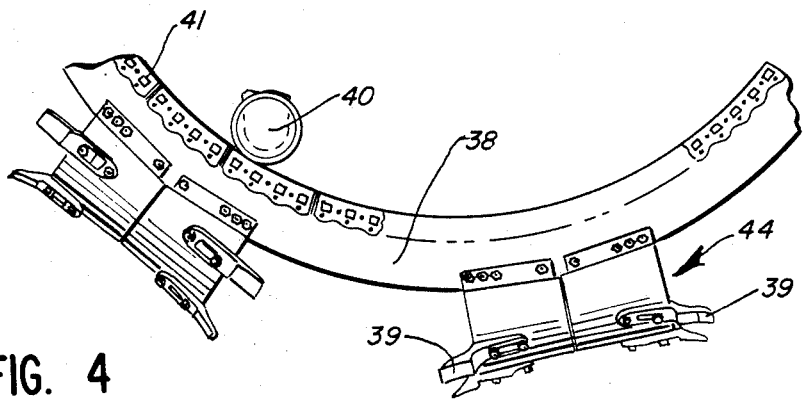
FIG. 4

DITCHER METHOD AND APPARATUS

BACKGROUND OF THE INVENTION

1. Field of the Invention

This invention relates to ditching operations, and in particular to the provision of drainage ditches alongside a railroad track.

2. Description of the Background Art

It is well-known in the railroad construction field that damage to the railroad bed may result from improper drainage of water therefrom. The cost of maintaining such railroad beds is very high, and such destruction thereof is a vexatious and continuing problem in the field. Gangs of laborers are normally used to clear out ditches and effect suitable draining alongside the railroad track, and such manual labor gangs are not only expensive, but also relatively inefficient in maintaining the extensive track right-of-ways.

SUMMARY OF THE INVENTION

The present invention comprehends an improved method and apparatus for ditching the terrain alongside a railroad track to provide facilitated, low cost, relatively high speed provision of suitable drainage ditches for effectively improving the life of the ballast and railbed.

The invention comprehends a novel method of excavating a drainage ditch alongside a railroad track or the like wherein an excavating wheel is provided having an annular array of scoops. The wheel is rotated about a horizontal axis while the wheel is moved along the track as on a suitable support car. Rotation of the wheel causes the scoops at the bottom of the wheel to engage the terrain adjacent the track. The axis of the wheel is selectively caused to extend within the range of perpendicular to the longitudinal extent of the track to substantially parallel thereto, whereby the scoops may excavate a ditch correspondingly in the range of a narrow trench having a width substantially equal to the transverse extent of the scoop to a wide ditch having a profile corresponding to the circumference of the wheel as defined by the scoops.

Means are provided for causing the wheel to be selectively raised and lowered while concurrently changing the angularity of the axis thereof to the longitudinal extent of the track so as to provide optimum arrangement of the ditch as the ditch is formed continuously during the movement of the wheel along the side of the railroad track. The operator may suitably control the parameters of the wheel disposition to effect an optimum formation of a drainage ditch within the range of narrow to wide configuration thereof as discussed above.

The invention further comprehends the conveying of the excavated material from the scoops of the excavating wheel for suitable disposal.

In the illustrated embodiment, the excavated material is dropped from a top position of the wheel onto a subjacent belt conveyor which carries the excavated material to a discharge conveyor, which may be positioned suitably to discharge the excavated material remotely alongside the track, or to an adjacent hopper car for subsequent disposal at a remote location.

The wheel is rotated at a speed which causes excavated material, at times, to be thrown from the scoop and means are provided for causing rotation of the wheel suitably to a position spaced from the track outwardly of the ditch for improved facilitated disposal without the need for operation of the conveyor means.

The apparatus includes means for continuously raising and lowering the wheel to accommodate the wheel to the level of the subjacent terrain to be excavated, while at the same time permitting the wheel to be pivoted about a vertical axis so as to cause the axis of rotation of the wheel to be selectively disposed in the range of angularity, as discussed above.

The wheel in the illustrated embodiment is carried on the distal end of a boom which permits the wheel to be disposed substantially below the level of the support car to engage the subjacent terrain alongside the track over a wide range of subjacent levels.

The wheel is selectively positionable about the vertical axis at the distal end of the boom so as to extend over a range of angularity to the boom of approximately 90° perpendicular to the longitudinal extent thereof to substantially parallel thereto.

In one form, the wheel is mounted to the distal end of the boom to be selectively disposable on either side of the boom distal end in the use thereof.

In one form, the wheel is reversibly rotatable and is provided with double-ended scoops, permitting excavation in either direction of rotation of the wheel and facilitating the throwing of the scooped material outwardly from the ditch, as discussed above.

The wheeled support, in the illustrated embodiment, comprises a self-powered flatcar, with the trucks thereof adjustably supporting the bed of the flatcar to permit leveling of the bed for further improved operation of the apparatus at all times.

In the illustrated embodiment, the flatcar is provided with an outwardly opening recess for accommodating the excavator wheel in a storage position, such as when the apparatus is being moved from one site to another.

The ditching method and apparatus of the present invention is extremely simple and economical, while yet providing a highly improved, low cost ditching operation facilitating improved maintenance of a railroad track bed by providing improved drainage thereof.

BRIEF DESCRIPTION OF THE DRAWING

Other features and advantages of the invention will be apparent from the following description taken in connection with the accompanying drawing wherein:

FIG. 3 is an enlarged elevation of the excavating wheel carried on the mounting frame at the end of the boom;

FIG. 4 is a fragmentary elevation illustrating a modified form of excavating wheel having double-ended scoops;

DESCRIPTION OF THE PREFERRED EMBODIMENTS

Figure 7:
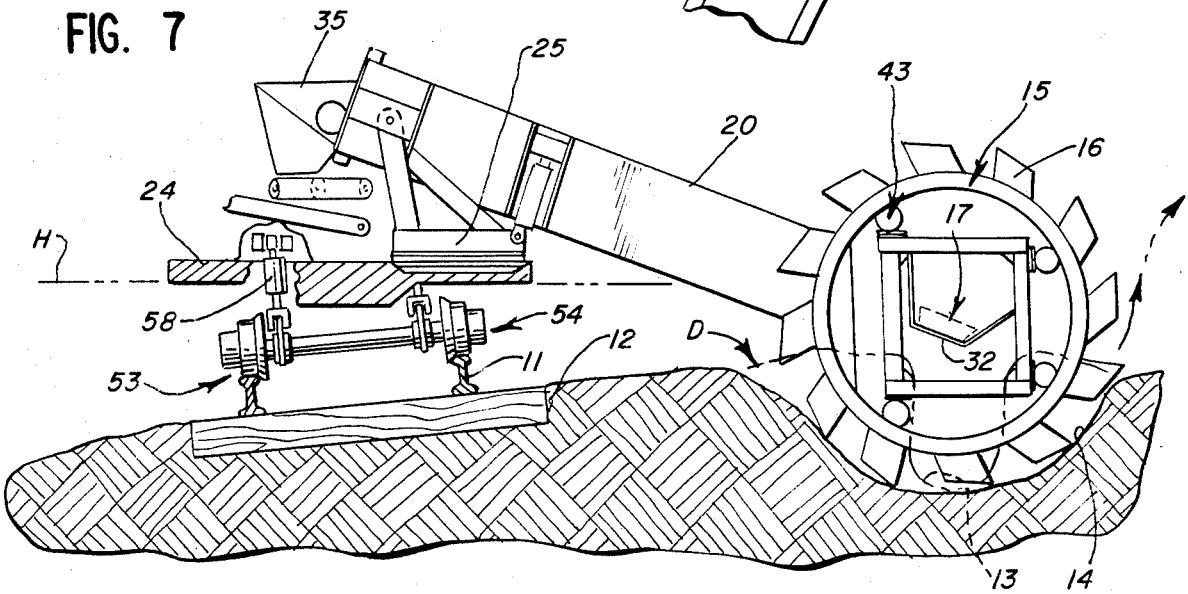
FIG. 7 is a schematic end view illustrating the use of the excavating wheel in throwing the excavated material outwardly from the ditch in one mode of operation.

In the exemplary embodiment of the invention as disclosed in the drawing, a ditcher apparatus generally designated 10 is provided for excavating a ditch alongside a railroad track 11, such as for providing improved drainage of the track bed 12. As seen in FIG. 7, the ditch D may have a crosssectional configuration within the range of a narrow, deep trench 13 to a shallow, wide ditch 14. The invention comprehends the forming of the ditch to have any suitable configuration within this range.

More specifically, the invention comprehends forming the drainage ditch by providing an excavator wheel 15 having an annular array of excavating scoops 16 on the periphery thereof. The wheel is caused to rotate about an axis 17 which, as seen in FIG. 1, is normally horizontal, while the wheel is moved along the track so as to cause the scoops at the bottom portion of the wheel to engage the subjacent terrain T adjacent the track.

Figures 1, 2:
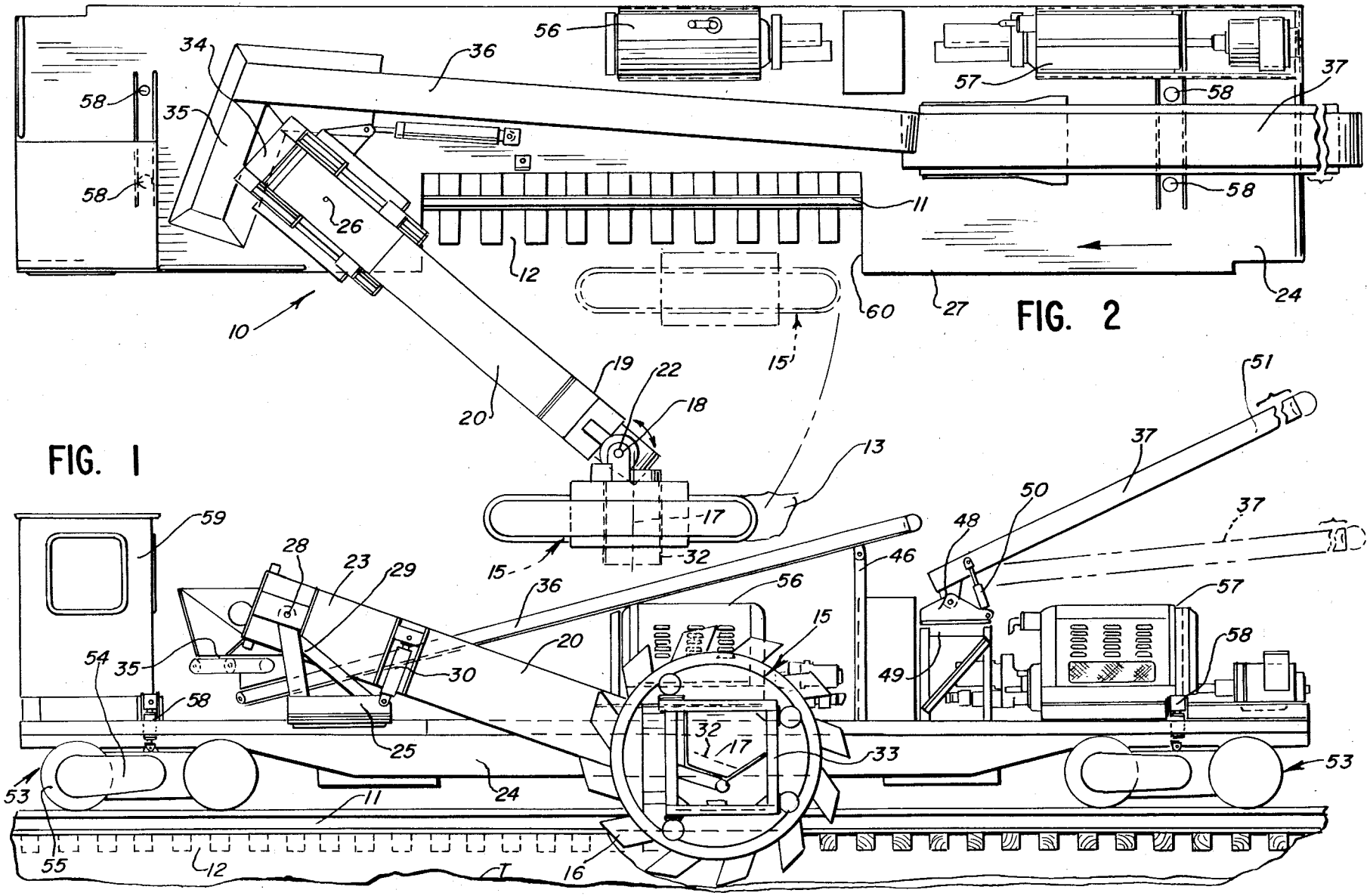
FIG. 1 is a side elevation of an apparatus embodying the invention.
FIG. 2 is a plan view thereof.

The excavator wheel is positionable about a vertical axis 18 at the distal end 19 of a boom 20 so that the wheel rotational axis may extend selectively in the range of perpendicular to the longitudinal extent of the track 11, as seen in FIG. 2, or substantially parallel thereto,as seen in FIG. 7. As seen in FIG. 2, in the illustrated embodiment, the wheel is swung about axis 18 by means of a piston cylinder mechanism 21 connected between the wheel and the distal end 19 of the boom, with the wheel being pivotally mounted to the distal end by a suitable pivot structure 22.

The inboard end 23 of boom 20 is mounted to the bed 24 of a support flatcar on a rotatable platform 25, which, as seen in FIG. 2, permits the boom to swing about a vertical axis 26 for selectively adjusting the spacing of the excavator wheel from the side 27 of the support car 24. End 23 of the boom is pivoted for swinging vertically about a horizontal pivot 28 mounted to platform 25 by suitable supports 29, and is raised and lowered by means of a hydraulic cylinder 30 extending between the boom and the platform.

As shown in FIGS. 1 and 7, boom 20 may extend angularly downwardly from the support car 24 to cause the scoop 16 of the excavator wheel to engage the subjacent terrain in effecting the ditching operation. The wheel may be raised and lowered by suitable operation of the hydraulic cylinder 30 and may be caused to rotate about the vertical axis 22 at boom end 19 by the mechanism 21 so as to cause the excavator wheel to accurately follow the terrain T as the apparatus is moved along the railroad track.

In the illustrated embodiment, scoops 16 open radially inwardly so that when they reach an upper portion of the annular travel, as seen in FIG. 1, the excavated material drops downwardly therefrom onto a conveyor 31 extending longitudinally through boom 20. A suitable chute 32 is provided on a cage 33 for guiding the dropped excavated material onto the conveyor. The inboard end 34 of the conveyor transfers the excavated material onto a transverse conveyor 35 which, in turn, transfers the excavated material to a longitudinal conveyor 36 for subsequent transfer to a discharge conveyor 37, all of which conveyors are carried on the flatcar support 24, as seen in FIG. 2.

As seen in FIG. 2, guide chute 32 may be selectively adjustably mounted to the cage 33 so as to extend away from track 11 to discharge the excavated material dropped from the scoops 16 to a position outwardly of the excavated ditch. Where conditions permit such discharge, the conveyor system need not be operated, thus permitting further facilitated ditching operation.

Referring now more specifically to FIG. 3, scoops 16 are mounted to a ring 38 of the excavator wheel and are provided with leading replaceable teeth 39 for improved facilitated excavation of the terrain T in the operation of the apparatus. As indicated above, each of the scoops opens radially inwardly toward wheel axis 17 so that when the scoops are brought to the uppermost position of the annular path of movement, the excavated material therein drops downwardly through the cage 33 and chute 32 onto the conveyor 31. As seen in FIG. 3, the ring 38 is guided for movement around the axis 17 by suitable rollers 40 carried on the cage, and is driven by a suitable sprocket 41 carried on the ring from a suitable drive sprocket 42 driven by an electric motor 43 mounted to the cage.

In a modified form, the scoops may comprise double-ended scoops, such as scoops 44 illustrated in FIG. 4. The double-ended scoops comprise opposite, outwardly opening scoops similar to scoops 16 and permit the excavator wheel to be run in either of the reverse directions of rotation by the drive motor 43, as desired.

Figure 6:
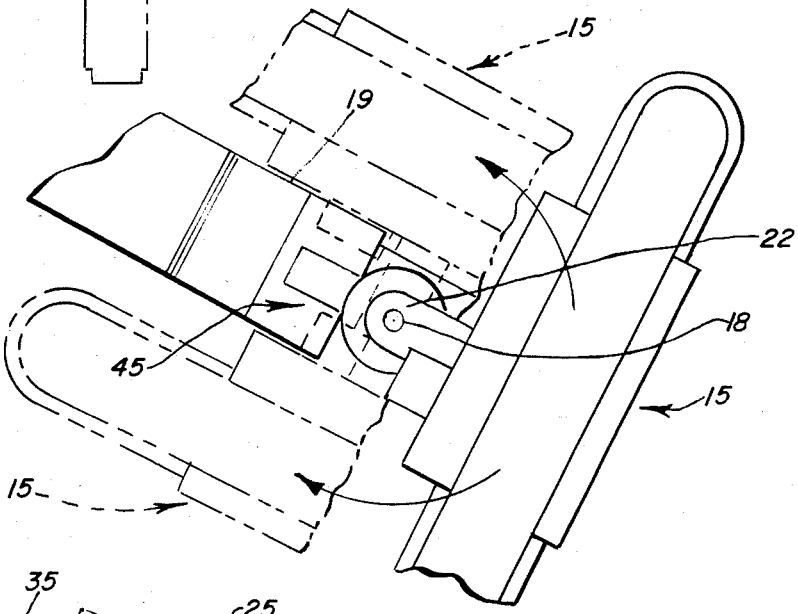
FIG. 6 is a fragmentary plan view illustrating a modified form of the invention wherein the excavating wheel is selectively disposable over a range of 180° about the distal end of the boom.

Referring to FIG. 6, a modified form of positioning means for the wheel relative to boom end 19 is shown to comprise means 45 for selectively positioning the excavator wheel over a range of approximately 180° to either side of the boom end 19, providing further facilitated flexibility in the use of the excavating apparatus.

In the illustrated embodiment, the inclined longitudinal conveyor 36 is fixed on suitable supports 46 to the car bed. Similarly, the hopper-type transverse conveyor 35 is fixedly mounted to receive the material from the movable lower end 34 of boom conveyor 31.

The discharge, or casting, conveyor 37, however, is mounted to a swivel 48 rotatably mounted on a support 49 carried on the car bed 24, and is angularly adjustable by means of a piston device 50 so as to permit facilitated control in the discharge of the excavated material therefrom.

Figure 5:
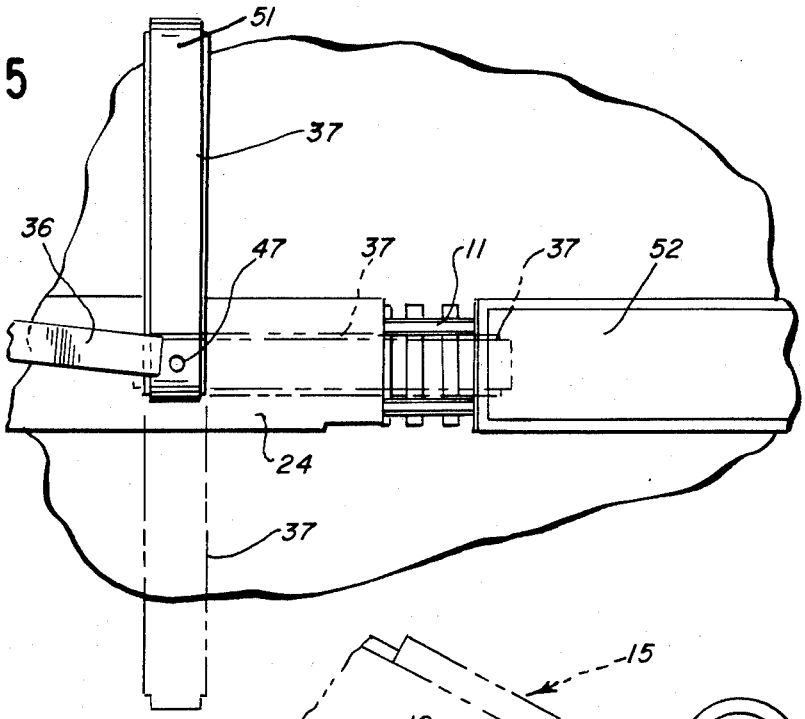
FIG. 5 is a schematic plan view illustrating the selective disposition of the discharge conveyor for delivering the excavated material to either side of the track or to an adjacent hopper car, as desired.

Referring to FIG. 5, the casting conveyor may be selectively positioned about the vertical axis 47 of the rotatable platform so as to have the distal end 51 of the casting conveyor cantilevered outwardly from either side of the car bed 24, as shown in full and broken lines in FIG. 5, or selectively disposed to extend beyond the end of the car bed 24 to overlie a hopper car 52, such as where it is desired to transport the excavated material to a remote site.

In the illustrated embodiment, the apparatus is moved along track 11 by powered wheeled trucks generally designated 53. The trucks include suitable drive mechanism 54 for driving wheels 55 thereof. Suitable hydraulic power for operating the drive mechanism is provided from a suitable travel engine 56 carried on the support bed 24. Other hydraulically operated apparatus of the ditcher 10 is powered from a work engine 57, also carried on the support bed 24. As best seen in FIG. 2, each of the travel engine 56 and work engine 57 is mounted at the side of the support bed 24 opposite the side from which the boom normally extends so as to act as a counterbalance weight in the operation of the excavator wheel.

At times, the track 11 is inclined from side to side as at curve portions thereof. Such a condition is illustrated in FIG. 7. The invention comprehends provision of means for maintaining the support bed 24 substantially level comprising hydraulically operated supports 58 for adjustably mounting the wheeled trucks 53 to the support bed 24. Thus, as seen in FIG. 7, the wheeled trucks may be inclined relative to the flat extent of the support bed 24 so as to cause the support bed to be effectively level, notwithstanding the sideward inclination of the track. It has been found that by maintaining the support bed level at all times, improved operation of the apparatus, including the conveyor belts, is obtained.

As further illustrated in FIG. 7, rotation of the excavator wheel has been found to effect a throwing of certain of the excavated material, such as tufts of grass, etc., and by suitably controlling the speed and rotation of the wheel, facilitated disposal thereof may be readily effected.

As illustrated in FIG. 7, where the rotational axis of the excavator wheel extends perpendicular to the longitudinal extent of the track, a substantially deep and narrow trench 13 results from the ditching operation. Where the wheel is turned 90° so as to have the rotational axis extend generally parallel to the longitudinal extent of the track, a relatively shallow, wide arcuate ditch generally conforming to the angular configuration of the periphery of the excavator wheel is obtained. By suitably disposing the angle of rotation within this range, any desired intermediate configuration may be readily obtained.

The invention further comprehends provision of an operator's cab 59 provided with suitable controls for operating the ditcher apparatus. Use of the improved ditcher permits ditching operations to be effected at relatively high speed, such as where the apparatus is moved along the railroad track at speeds of up to approximately 1/10th of a mile per hour. Excellent ditching operation has been effected with such apparatus traveling at a speed of approximately, 0.08 mph and excavating wheel having a ring support of approximately 8 feet.

Thus, in broad aspect, the invention comprehends an improved ditcher for excavating a ditch alongside a railroad track wherein an excavator wheel is carried on a flatbed railroad car by means of a cantilevered boom. The excavator wheel is caused to rotate about a horizontal axis which may be selectively positioned over a range from between extending perpendicular to the longitudinal extent of the track to a position wherein the axis extends substantially parallel thereto. By moving the excavating wheel upwardly and downwardly and arranging the axis of rotation at the desired angle, a wide range of drainage ditch and the like configurations may be readily effected with minimum manpower and at relatively high speed and efficiency. To permit facilitated transport of the apparatus from one side to another, the support bed 24 is provided with a suitable outwardly opening recess 60 for effectively receiving the excavator wheel in a storage position, as shown in broken lines in FIG. 2.

The apparatus is extremely simple and economical of construction and use.

The foregoing disclosure of specific embodiments is illustrative of the broad inventive concepts comprehended by the invention.

We claim:

1. A ditcher for continuously excavating a ditch alongside a railroad track comprising:

a support;

wheeled trucks spaced along the longitudinal extent of the track and carrying the support to ride on the railroad track;

means for adjusting the transverse angular disposition of the support relative to the trucks for maintaining the support level notwithstanding an inclination of the tracks on which the trucks are disposed;

means for moving the support along the track on said trucks;

a boom having one end movably mounted to said support;

means for swing the boom relative to the support about a first vertical axis and adjustably angularly relative to the horizontal including angular disposition of the boom with the distal end thereof below the level of said support to provide facilitated selection of the depth and spacing of said distal end from the wheeled support;

an excavation wheel;

mounting means for mounting said excavating wheel to said distal end of the boom for rotation about a horizontal axis of rotation, said wheel having a plurallity of excavating scoops for excavating the subjacent terrain and lifting the excavated material as a result of rotation of the wheel about said axis of rotation, and for adjustable positioning of said axis of rotation about a vertical axis;

means for rotating said wheel about said horizontal axis;

means for positioning said wheel about said vertical axis of rotation to effect a desired ditch width; and means for conveying the excavated material from said wheel for controlled disposal, whereby said ditcher operates substantially identically regardless of the transverse inclination of the tracks upon which the ditcher is situated.

2. The ditcher of claim 1 wherein said conveying means comprises conveyor belts having side edges maintained horizontally opposed by the maintained level condition of the support by said truck adjusting means.

3. The ditcher of claim 1 wherein said wheeled trucks are disposed at opposite ends of said support.

4. The ditcher of claim 1 further including heavy power operating means carried on one side of the support, said boom mounting means being arranged to dispose said excavating wheel at the opposite side of the support whereby said power operating means counterbalance said boom and excavating wheel.

5. The ditcher of claim 1 wherein said excavating wheel defines an annular guide surface, and said mounting means includes rollers engaging said guide surface for guiding said wheel rotatively about said axis of rotation, scoops being arranged to discharge the lifted excavated material downwardly onto the conveying means between rollers.

6. The method of excavating a ditch alongside a transversely inclined portion of a railroad track comprising the steps of:

providing a support and an excavating wheel movably mounted on the support and having an annular array of scoops;

adjusting the angular disposition of the support to achieve a level orientation;

rotating the wheel about a horizontal axis while moving the wheel along the track and concurrently causing the scoops at the bottom of the wheel to engage the terrain adjacent the track; and positioning the wheel to have said axis disposed selectively within the range of perpendicular to the longitudinal extent of the track to parallel thereto, whereby the scoops may excavate a ditch correspondingly in the range of a narrow track having a width equal to the transverse extent of the scoops to a wider ditch having a profile corresponding to the circumference of the wheel, whereby a continuous ditch of uniform depth is provided in relation to the track regardless of the transverse inclination of the track.

7. The method of excavating a ditch of claim 6 including the further step of conveying the excavated material from the scoops for desired disposal.

8. The method of excavating a ditch of claim 6 including the further step of causing the excavated material to be thrown from the scoops to a position spaced from the track ooutwardly of the ditch being excavated.

9. The method of excavating a ditch of claim 6 including the further step of transferring the excavated material from the scoops to a railway car on said track for desired disposal.

10. The method of excavating a ditch of claim 6 wherein the excavating wheel is caused to be adjustably raised and lowered to continuously engage the subjacent terrain as the wheel is moved along the track.

11. The method of excavating a ditch of claim 6 wherein the wheel axis is caused to be adjusted angularly to the longitudinal extent of the track and the excavating wheel is caused to be adjustably raised and lowered to continuously engage the subjacent terrain as the wheel is moved along the track to provide a variable configuration ditch in accordance with the characteristics of the terrain being ditched.

* * * * *